US005308503A

United States Patent [19]

Ström

[11] Patent Number: 5,308,503

[45] Date of Patent: May 3, 1994

[54] PURIFICATION OF INDUSTRIAL LUBRICATING AGENTS

[75] Inventor: Gunnar Ström, Uppsala, Sweden

[73] Assignee: Pegasus Separation AB, Uppsala, Sweden

[21] Appl. No.: 995,909

[22] Filed: Dec. 22, 1992

Related U.S. Application Data

[63] Continuation of Ser. No. 689,785, Jun. 6, 1991, abandoned.

[30] Foreign Application Priority Data

Nov. 21, 1988 [SE] Sweden ..... 8804206

[51] Int. Cl.[5] ..... B01D 21/01

[52] U.S. Cl. ..... 210/728; 210/712; 210/730; 210/731; 210/732; 210/167; 210/195.1; 210/196; 210/197; 210/202; 210/206; 252/52 R; 252/524

[58] Field of Search ..... 210/708, 725, 727, 728, 210/729, 730, 731–735, 738, 167, 172, 195.1, 196, 197, 202, 205, 206; 252/52 R, 52 A

[56] References Cited

U.S. PATENT DOCUMENTS

| | | | |
|---|---|---|---|
| 2,637,737 | 5/1953 | Gibbs | 210/197 |
| 3,194,758 | 7/1965 | Lissant | 210/732 |
| 3,227,650 | 1/1966 | Bell | 210/738 |
| 3,528,284 | 9/1970 | Skoglund et al. | 210/167 |
| 3,835,045 | 9/1974 | Hussissian | 210/709 |
| 3,872,000 | 3/1975 | Hamada et al. | 210/732 |
| 3,948,784 | 4/1976 | Keillic et al. | 252/524 |
| 3,974,116 | 8/1976 | Lissant | 210/732 |
| 4,120,815 | 10/1978 | Raman | 210/708 |
| 4,366,069 | 12/1982 | Dudrey et al. | 210/167 |
| 4,452,711 | 6/1984 | Laemmle | 252/524 |
| 4,518,512 | 5/1985 | Kanamori | 252/524 |

FOREIGN PATENT DOCUMENTS

| | | | |
|---|---|---|---|
| 47-37586 | 9/1972 | Japan | 210/708 |

OTHER PUBLICATIONS

G. Blomquist et al., "Fordelning AV Mogelsvampskonidier I Polymeria Tvafassystem", 1984 ISBN 91-7464-224-3 ISSN 0346-7821, Umea.

Derwent's abstract, No. 76-65 593/35, JP 51 079 959, publ. week 7635 (Mitsubishi Rayon KK).

Strom; "Quantitive and Quantitative Analysis of Microorganisms Particularly Fungal Spores Methodological Developments"; UMEA University Medial Dissertations; No. 175, 1986.

Blomquist et al.; "Fordelning AV Mogelsvampskonidier I Polymera Tvafassystem"; Arbette Och Halsa; Ventgenskaplig Skriftserie; 1984:31.

Wuithier et al.; "Raffinage et Genie Chimique"; Publications de l'Institut Francais du Petrole; Collection Science et Technique du Petrole; No. 5; 1972; p. 1261.

*Primary Examiner*—Peter A. Hruskoci

*Attorney, Agent, or Firm*—Bacon & Thomas

[57] ABSTRACT

Use of polymeric two-phase systems for removing microbial contaminants from industrial lubricating agents, a method of purifying microbial contaminated lubricating agents by mixing the lubricating agent with a polymeric two-phase system, allowing the mixture to separate so as to form a top-phase containing the lubricating agent and a bottom-phase containing at least part of the microbial contaminants, and separating at least a major part of the microbially enriched bottom-phase from the top-phase, a plant for microbial purification of lubricating agents comprising a mixing tank (4) having means (7, 8) for feeding microbially contaminated lubricating agent (S) to the mixing tank, means (13) for feeding a polymeric two-phase system to the mixing tank, a stirrer (5) in the mixing tank, means (9, 10) for feeding the mixture to a separation device (6) for separating the mixture into a top-phase (T) containing lubricating agents, and a bottom-phase (B) containing microbial contaminants, and means (18) for recovering the top-phase of the two-phase system, and a lubricating agent concentrate, in which at least part of the lubricating agent at the same time forms part of the top-phase component of the polymeric two-phase system.

23 Claims, 2 Drawing Sheets

PURIFICATION OF INDUSTRIAL LUBRICATING AGENTS

This application is a continuation of application Ser. No. 07/689,785, filed Jun. 6, 1991, now abandoned.

TECHNICAL FIELD

The present invention relates to the technical field of industrial lubricating and/or cooling agents, especially such agents for use in metal working. More specifically the invention relates to purification of such agents, in the following referred to as "lubricating agents", as regards microbial contaminants by using polymeric two-phase systems.

BACKGROUND OF THE INVENTION

Cutting oils and cutting liquids represent a common type of industrial lubricating agents which are widely used in the engineering industry in connection with cutting, turning, drilling, grinding and similar machining of materials. Their primary function is to increase the useful life of the tools by acting as a cooling and lubricating agent between the tools and the work pieces. Cutting oils—as well as lubricating agents in general—consist of so-called base oils, which may be based on mineral oils or be synthetic or semi-synthetic. By "cutting liquids/lubricating liquids we mean aqueous emulsions of cutting oils and lubricating oils respectively.

Rapid microbial growth, primarily of bacteria but also of fungi, often restricts the useful life of the cutting liquids to a few months. Already after such a short time of use the bacterial concentration may have increased from zero to the order of $10^8$ cells/ml. The growth of microorganisms not only results in a deteriation of the properties of the cutting liquid, but also creates an unpleasant odour. In connection with e.g. grinding and turning also airborne bacteria can be spread in aerosol form, thereby creating a further problem in the working environment.

Cutting liquids contain a plurality of components, from bactericidal preparations to anti-foam agents and corrosion inhibitors. Several of these components, together with a micro-flora of bacteria and fungi, are considered to be capable of causing problems, especially eczema and skin irriation, for industrial workers (Wahlberg, J. E. 1976, Skin-influence of oil, Esso Symposium 1976).

Since no practically/economically useful methods presently are available for cleaning the cutting liquid when in use, the microbial contamination is usally coped with by simply discarding the entire contaminated cutting liquid and replacing the same with fresh cutting liquid. This procedure does not only cause high costs for the disposal and for the fresh cutting liquid, but it also creates high extra costs caused by the shut-down which is necessary for emptying and cleaning the tanks and the distribution systems for the cutting liquid and for re-filling the systems with fresh cutting liquid.

Microbial growth in cutting liquids is thus a great problem in today's engineering industry and there is a great need of means for extending the useful life of cutting liquids. It may as an example be mentioned, that about 10,000 tons of cutting liquids in 1977 were used only in Sweden, of which about 2,000 tons were emulsion concentrates (LO:s Report on Cutting Oils). The costs for the acquisition and disposal were estimated to be of the order of 140 to 200 millions SEK, to which should be added the far higher costs for shut-down in connection with the exchange of cutting liquid.

Similar problems with microbial contamination occur when using and disposing of other types of lubricating oils, for example different kinds of hydraulic oils, used oils, etc.

Derwent Abstract No. 76-65593x/35, JP 51079959 discloses an agent for the treatment of contaminated waste water, including used cutting oil, by adsorption of the contaminants. The adsorbent consists of very small complex bodies comprising inorganic particles and an organic polymer. The inorganic particles may consist of active carbon or certain metal hydroxides.

Aqueous polymeric two-phase systems as such have been known for a long time and have been used in laboratories for biochemical and microbiological analyses and separations, e.g. for separating macro molecules, cell particles and whole cells (e.g. Albertsson P. Å. 1960, Partition of Cell Particles and Macromolecules, 2nd edition, Almquist & Wiksell, Uppsala; Blomquist G. and Ström G. 1984, The Distribution of Mould Fungi Conidies in Polymeric Two-Phase Systems, Work and Health No. 31, Ström G. 1986, Qualitative and Quantitative Analysis of Microorganisms Particularly Fungal Spores-Methodological Developments, doctor's thesis, University of Umeå). However, polymeric two-phase system have found few technical uses.

Polymeric two-phase systems substantially consist of two aqueous solutions of polymers having different molecular weights. When the two polymer solutions are mixed in certain proportions, two immiscible aqueous phases are formed. The top-phase substantially contains the low molecular polymer and the bottom-phase substantially contains the high molecular polymer. The water contents in the systems is high, usually between 80–98% depending on the choice of the phase polymers. In an alternative type of polymeric two-phase systems basically the same result can be obtained by replacing the high molecular polymer with a suitable water-soluble salt, e.g. phosphate buffer.

In polymeric two-phase systems particles or cells are distributed substantially between the top-phase, the interphase (the interface between the phases) and the bottom-phase; soluble macromolecules will be distributed between the top and bottom-phases.

In order to simplify the description we will in the following use the expressions "top-phase component" and "bottom-phase component" respectively when referring to those component/components of the polymeric system, which after mixing and separation of the system substantially are found in the top-phase and the bottom-phase respectively.

OBJECTS OF THE INVENTION

The present invention aims at reducing or eliminating the above mentioned problems and draw-backs of the prior art systems for using, handling and getting rid of industrial lubricating agents, in particular cutting liquids in the engineering industry.

A special object of the invention is to provide lubricating agent/cutting liquid systems having a considerably longer useful life than today's systems.

Another special object of the invention is to provide a purification process which makes it possible to purify lubricating liquids microbially while in use, thereby considerably reducing the shut-down time because of change of liquid.

A further object of the invention is to provide purification methods and means for lubricating liquids which meet high demands on industrial hygien and working environment.

A still further object of the invention is to provide an improved analysis method for determining the contents of microbial contaminants in industrial lubricating agents, especially cutting liquids.

A further object of the invention is to provide a lubricating agent which is also capable of serving as the top-phase polymer in a polymeric two-phase system for separating microbial contaminants from a lubricating agent.

These and other objects and advantages of the invention will be explained further below.

SUMMARY OF THE INVENTION

The special features which characterize the invention are indicated in the appended claims. Different aspects of the invention are indicated in the co-ordinated claims. Preferred embodiments of the invention are indicated in the sub-claims.

In summary, it can be said that the invention in its different aspects is founded on the basic concept of utilizing polymeric two-phase systems for separating microbial contaminants from contaminated lubricating agents. In accordance with the invention the polymeric two-phase system will be designed in such a manner that there is formed, after mixing with a lubricating agent and phase separation, a top-phase containing lubricant and a bottom-phase containing at least part of the microbial contaminants, so that at least a major part of the microbial contaminants can be removed together with the bottom-phase, which can easily be separated from the top-phase. (For the purposes of this description also the inter-phase is included in the bottom-phase.)

One aspect of the invention comprises a method of purifying microbially contaminated lubricating agents, which is characterized by the steps of mixing the lubricating agent with a polymeric two-phase system, allowing the mixture to separate so as to form a top-phase containing the lubricating liquid and a bottom-phase containing at least a part of the microbial contaminants, and separating at least a major part of the microbially enriched bottom-phase from the top-phase.

Another aspect of the invention consists of a plant for microbial purification of lubricating liquids. This plant is characterized in that it comprises a mixing tank having means for feeding microbially contaminated lubricating liquid to the mixing tank, means for feeding at least one of the components of a polymeric two-phase system to the mixing tank, at least one stirrer in the mixing tank, means for feeding the mixture to a separation device for separating the mixture into a top-phase containing lubricating agent and a bottom-phase containing microbial contaminants, and means for recirculation of the top-phase of the two-phase system.

A further aspect of the invention consists of a new lubricating oil concentrate which comprises lubricating oil and optionally conventional additives for lubricating oils and which is characterized in that at least part of the lubricating oil also is included in the top-phase component of a polymeric two-phase system.

A further aspect of the invention relates to a new cutting liquid which is characterized in that it consists of an aqeuous emulsion of the cutting oil concentrate according to the invention.

BRIEF DESCRIPTION OF THE DRAWINGS

The enclosed drawings show the following.

DESCRIPTION OF PREFERRED EMBODIMENTS

Figure 1:
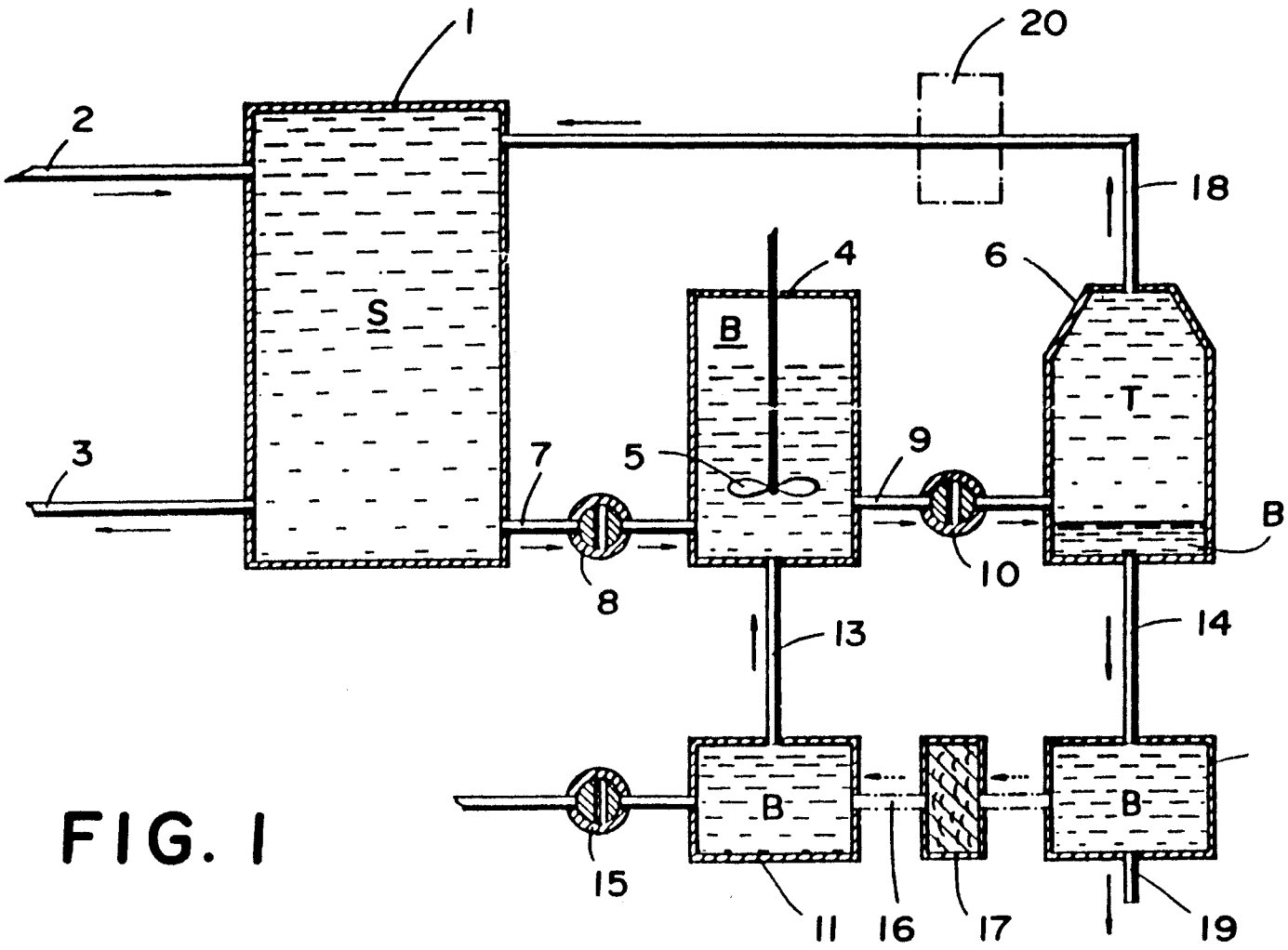
FIG. 1 is a schematic presentation of a plant according to the invention adapted for cleaning of industrial cutting liquids, wherein the dashed lines illustrate alternative embodiments.

The enclosed drawing schematically shows a purification plant illustrating how the principle of the cutting liquid cleaning according to the invention may be put into practice. The plant comprises a tank 1 for cutting liquid S containing the top-phase component. The cutting liquid S is continuously being circulated between the tank 1 and work stations (now shown) through inlet conduits 2 and outlet conduits 3 of the tank. Suitable distribution conduits, pumps, etc. are used for transporting cutting liquid to and from the work stations. This is quite conventional technique and will therefore not be described further in this context.

In the shown embodiment the plant comprises a mixing tank 4, in which there is a stirrer 5, and a separator 6. A conduit 7, in which there is a shut-off valve 8, interconnects the cutting liquid tank S with the mixing tank 4. The latter can also be connected to the separator 6 through a conduit 9 having a shut-off valve 10. There is further shown a supply container 11 for fresh or recovered bottom-phase component and a collection container 12 for used bottom-phase. The supply container 11 is connected to the mixing tank 4 through a conduit 13, and a conduit 14 interconnects the collection container 12 with the bottom part of the separator 6. Fresh bottom-phase component can be supplied to the supply container 11 from a supply (not shown) through a conduit having a valve 15. An interconnecting conduit 16 makes it possible, if desired, to re-use bottom-phase from the container 12 through a (dash-dotted) conduit 16, which may have a suitable rough filter 17. A return conduit 18 returns purified cutting liquid to the tank 1.

In accordance with the invention the described plant can be used i.a. as follows for purifying microbially contaminated cutting oil circulating through the tank 1. It should in this context especially be noticed that the cleaning can be carried out without any need of interruping the feeding of cutting liquid to the work stations; this means that the circulation of cutting liquid through the conduits 2 and 3 may continue as usual.

Contaminated cutting liquid S is supplied to the mixing tank 4 by opening the valve 8 in the conduit 7. Fresh or re-used bottom-phase is supplied to the mixing tank 4 through the conduit 13. The supply valves are then closed and top and bottom-phase components are mixed with the contaminated cutting liquid.

After the mixing has been completed the valve 10 is opened and the mixture is transferred to the separator 6, wherein it is allowed to separate into a top-phase T and a bottom-phase B. A major or minor part of the microbial contaminants from the top-phase T to the bottom-phase B will then move into the bottom-phase B, but the cutting liquid will remain in the top-phase T.

After completion of the separation the purified top-phase will be returned to the cutting oil tank 1 through the conduit 18. The bottom-phase B together with its microbial contaminants will be discharged through the bottom conduit 14. Depending on the particular bottom-phase component which is used, the bottom-phase B can either be discarded through a drain 19 or be returned to the tank 11, preferably after rough filtering and/or other purification in the device generally designated 17. Disposal is preferred when the bottom-phase component consists of cheap material, whereas re-use is preferable when it contains expensive material such as fractionated dextran.

If the bottom-phase component contains inorganic salts, such as phosphates and/or sulphates, the re-circulated top-phase will also contain a minor amount of the corresponding salt. Such salts may have an unfavourable effect on the properties of the cutting liquid, and it is then preferable to desalt the top-phase before returning it into the tank 1. For this purpose the plant shown in the drawing has been provided with a desalting device 20, which may be based on desalting principles which are known per se.

Top-phase polymers which are preferred according to the invention are comparatively low molecular hydrophilic polymers, especially polymers which are not solid at room temperature. However, hydrophilic polymers of higher molecular weight, which are solid at room temperature, can also be used within the scope of the invention. In the latter case it is preferred to also add an inorganic solvent, in which the polymer is soluble. By the addition of solvent it can be achieved that the cutting liquid will not leave any solid residue on evaporation; such a residue may have a detrimental effect on the utility of the lubricating liquid by leaving a hard crust on the machines.

In a preferred embodiment the top-phase component of the two-phase system comprises at least one polyalkylene glycol, especially a polyethylene glycol having an average molecular weight of 200–20,000, especially 400–10,000, in particular about 600–4,000.

According to another preferred embodiment it is advantageous to use, as the top-phase, also other hydrophilic polymers which are liquid at room temperature and/or at the temperature of use and which per se are useful in synthetic cutting oils as the single cutting oil component or together with other cutting oil components in synthetic or semi-synthetic cutting oils. Polyoxyalkylene-polyalcohol ethers such as polyoxyalkyleneglycol ethers, linear polymers of ethylene and/or propylene oxide are a few examples of preferred polymers, which are capable of simultaneously functioning as a cutting liquid and a top-phase component. Such lubricating liquids may, for example, contain at least about 2% by weight, especially at least 4, often at least 6% by weight of the polymer, especially at least 7% by weight.

In general, the concentration of the top-phase polymers in the lubricating liquid decreases with increasing molecular weight.

In the embodiment, in which also the bottom-phase component contains a polymer, such polymer preferably has a higher average molecular weight than the top-phase polymer. The bottom-phase polymer preferably has an average molecular weight of at least 40,000, and it is preferably cross-linked. Examples of suitable bottom-phase polymers are polysaccharides, in raw or refined form, especially cross-linked polysaccharides, in particular cross-linked dextran, starch, cellulose, polyglucose or cross-linked mono-, di- or oligosaccharides. Examples of other types of suitable bottom-phase polymers are polyvinyl alcohols of different average molecular weights. Polyvinyl alcohols can be recovered from the bottom-phase by e.g. precipitation.

The bottom-phase component may also advantageously comprise a small amount of a suitable agent distributing into the bottom-phase and promoting the transfer of the microbial contaminants from the top-phase to the bottom-phase. Such agents preferably carry positive electric charges which attract the negative charges on the cell surfaces of the bacteria. In such a case the system is preferably kept at a pH from neutral to slightly basic so as to expose the charges on the cell surfaces of the bacteria. Examples of such charge-exposing agents are hydrophilic polymers containing positively charged groups, e.g. DEAE-groups. Such positively charged agents may be present in very low concentrations (the order of magnitude of $10^{-2}\%$–$10^{-3}\%$) and still have a strong effect.

In the embodiment in which the bottom-phase component contains inorganic salts instead of a high molecular bottom-phase polymer, these salts may e.g. consist of common buffer salts such as alkali metal phosphates and sulphates and mixtures thereof. The amounts of such salts may vary within comparatively broad limits, the amount i.a. depending on the particular salts and the particular top-phase polymer being used. For example, good results are obtained when using a two-phase system comprising phosphate buffer in combination with low molecular polyethylene glycol, about 10–20% of each component.

The lubricating liquids according to the invention preferably comprise 1–16% by weight of lubricating oil, especially about 2–10% by weight of lubricating oil, at least about 2% by weight of top-phase component, especially at least about 4% by weight of top-phase component, and when the top-phase component comprises a low molecular polymer which is not solid at room temperature, preferably at least about 8% by weight of the top-phase component, the remainder essentially consisting of water. The upper limit for the amount of top-phase component is not particularly critical and will therefore primarily be chosen with regard to practical/economical considerations.

The use according to the invention of polymeric two-phase systems for separating microbial contaminants from contaminated lubricating liquids can also preferably be used for analysing the separated phase with regard to microbial contaminants. Such an analysis, which preferably will be performed substantially quantitatively or semi-quantitatively, gives a very rapid and reliable basis for judging the quality of the lubricating liquid and as a guide for determining what measures may be necessary to take, for example addition of biocides, exchange of lubricating liquid, etc. At present such analyses are performed by cultivation on suitable nutritions substrates, usually having the form of "sticks" to be dipped into the lubricating liquid. The cultivation requires several days to be completed and the error margins are considerable. This is a great drawback because the growth of contaminating biomass (which includes both bacteria and fungi) can be very rapid, especially when the contaminants approach critical concentrations. There is thus a great need of an analysis method capable of giving a reliable result within a few hours. When using polymeric two-phase systems according to the invention for analyses, a reliable response is obtained within a few minutes. When performing the analysis it is often desirable to be able to distinguish between live biomass and dead biomass since the latter normally does not reduce the quality of the lubricating liquid to any significant degree. This is also possible to achieve according to the invention by the use of markers, which can be split into detectable molecules of live biomass, especially fluorescent molecules.

The bottom-phase which is separated in the purification method for cutting oils according to the invention can be used for the analysis, but it is preferred to take a special sample for the analysis. As the bottom-phase it is preferred to use salts of the above indicated type instead of high molecular polymers. Although it is possible to carry out the separation in a single step, it is preferred to carry out separation in two steps (or possibly more).

Some preferred special embodiments of the invention will be described in the following part of the specification, wherein also the results of comparative tests are reported.

As already mentioned the starting point for the use of a two-phase technique for continuous purification of cutting liquids is that addition of cutting oil/emulsion concentrates to a two-phase system provides a top-phase in the nature of e.g. a cutting liquid/polymer phase which is well separated from a bottom-phase which collects microbial contaminants. Examples of factors which may influence the distribution of a microbial particle between the top, inter and bottom-phases are, for example, the choice of polymers—charged/uncharged polymers—the polymer concentration, the choice of pH and the ionic strength.

An important condition for successfully using polymer two-phase systems as a continuous purification technique for cutting liquids is that the addition of polymer does not negatively effect the properties of the lubricating liquid as regards lubricating and cooling properties, corrosion, tackiness etc. It appears from the tests reported below that the polymer additives used according to the invention do not have any unfavourable influence on the efficiency of the lubricating liquids, but on the contrary offers further advantages in certain respects. In these tests cutting liquids according to the invention were tested as regards physical and chemical properties and compared with a reference liquid which was the very same cutting liquid without any addition of polymer. Further tests were carried out using different bottom-phase polymers, as well as separation tests on cutting liquids containing bacterial cells and spores of mould fungi.

Test of Cutting Liquid With and Without Addition of Polymer (Top-Phase Polymer)

All of the tests were carried out at the Institute for Engineering Research ("Institutet för Verkstadsteknisk forskning") in Gothenburg.

In the test a mixture of 6 kg of Polyethylene glycol 600 (Kebo Lab AB, Solna), suspended in 4 kg water, was added to a mixture of 28 l of water plus 2 l emulsion concentrate (mineral oil based, fine emulsion) - Liquid 2. A mixture of 2 l of emulsion concentrate and 38 l of water was used as reference - Liquid 1.

The following properties of the two cutting liquids were studied;

* Effect on the useful tool life in twist drilling
* Crevice corrosion
* Effect on copper and aluminum
* Separation of leaking oil
* Foaming
* Sedimentation
* Residue after water evaporation, retaining forces.

The machining test was performed using production machining data on heat treatment steel (SS 2541-03) and a stable machine tool.

| Machining Test - Twist Drilling | |
|---|---|
| Equipment | |
| Work piece material: | SIS 2541-03 (260 HB) |
| Tool material: | High speed steel, SIS 2724, ϕ 6 mm |
| Numerically-controlled bed cutter: | SAJO VBF 450 |
| Machining Data | |
| Cutting speed | 17–35 m/min |
| Feed: | 0.17 mm/r |
| Depth of bores: | 24 mm (4 × d) |
| Warn-out test: | total destruction |

Pre-Treatment of Equipment

The work pieces are taken from one charge and are rolled in sequence. They are cut to a size of 200×30×375 mm (about 400 bores/plate) and spot faced.

The tools are normalized with narrow geometric tolerances and hardness variations.

Procedure

The work pieces (2) are clamped into the machine and the test program is designed so as to distribute the machining on both plates for each tool, the purpose being to avoid local unevenness in the material. The cutting speed is varied for different drills in order to obtain a relation between cutting speed and warn-out time (vT-curve).

Destruction of the tool is seen as vibrations and changing cuttings (the tip melts). This occurs within a few seconds.

The other tests were carried out according to test programs defined in IVF-report 87-03-18, supplementing a revision of IVF Result No. 71607.

Results

When evaluating these cutting liquid tests the scale 0, 1 and 2 was used. Grade 1 means generally acceptable for engineering products and 2 means increased effect in the respective test.

| | Liquid 1 | Liquid 2 (invention) |
|---|---|---|
| Machining test | 1 (2) | 2 |
| Corrosion | | |
| Steel | 2 | 2 |
| Cast iron | 0 | 2 |
| Attack on metals | | |
| Copper | 2 | 2 |
| Aluminum | 2 | 2 |

Comment. For both tests the same Cu contents, 51.4 mg/l, were measured using atom absorption spectrophotometer after a copper plate had been immersed in the liquids for two weeks.

| | | |
|---|---|---|
| Separation of leaking oil | 2 layers | 2 layers |

Comment. Liquid 1 has a turbid border zone, rough emulsion, but the border zone is clear for Liquid 2.

| Foaming | | |
|---|---|---|
| Foam column (15 cm), min. | 4.4 | 4.3 |
| Disintegration, min | 11.4 | 13.0 |
| Sedimentation | 30% | 50% |

Evaporation residue.

This test could not be carried out because it was not possible to evaporate Liquid 2 in a drying chamber at 40° C. A surface layer prevents evaporation of water.

Figure 2:
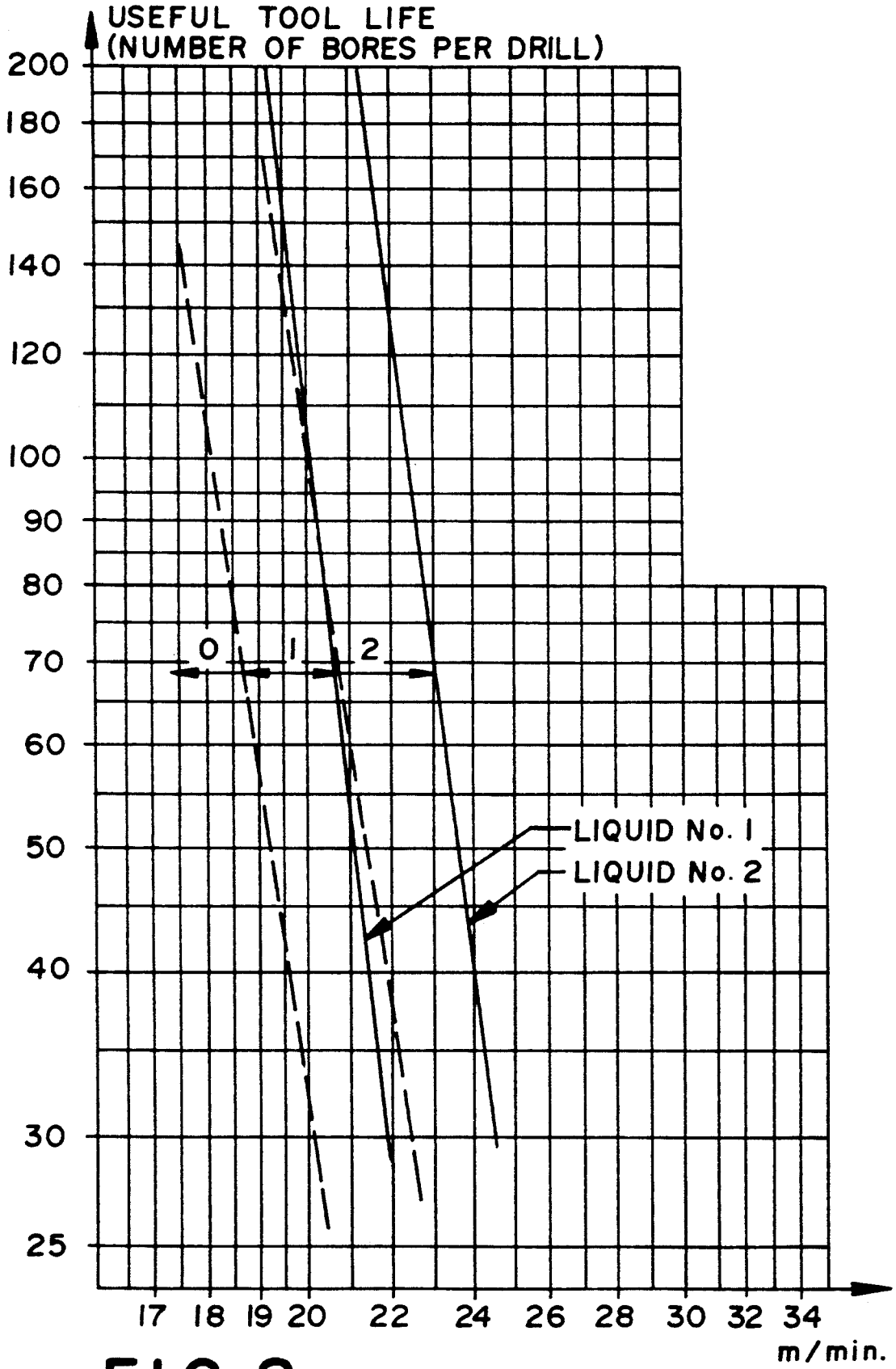
FIG. 2 is a diagram showing the results of comparative tests concerning the effect of cutting liquids on the useful life of twist drilling tools.

The test results show that the addition, according to the invention, of a top-phase polymer to a mineral oil based fine emulsion results in a plurality of positive effects as regards the properties of the cutting liquid. The metal-cutting test, which is an indirect measure of the cooling and lubricating properties of the liquid, showed reduced wear of the machine tool when using a cutting liquid containing a polymer. At a cutting speed of e.g. 22 m/min a useful tool life, expressed as the number of holes/drill, of about 28 was recorded for the normal cutting liquid, and a value of 130 for the corresponding polymer/cutting liquid mixture (see vT-curve in FIG. 2).

An important property for the useful life of a cutting liquid is the capability of efficiently separating contaminating leak oil from i.a. hydraulic systems. The comparative tests with and without admixture of polymer showed a lower tendency of leak oil emulgation into the cutting liquid according to the invention, which means that it is easy to remove leak oil from the system.

For both types of cutting liquids the attack on the metals copper and aluminum were minimal and the leakage of Cu-ions from a copper plate was identical (51.4 mg/l).

As regards corrosion, the cutting liquid according to the invention had an evident anti-corrosive effect on cast-iron whereas the effect of the reference liquid was unacceptable for engineering products. Both products showed an increased effect on steel.

Amine derivatives are often used as corrosion inhibitors in cutting liquids. These amines often cause working environmental problems. Furthermore, carbon/nitrogen compounds of the amine type can readily be used as a substrate by microorganism, thereby promoting the microbial growth. The evident corrosion inhibiting effect when adding a top-phase polymer according to the invention can make it possible to completely exclude amine compounds from these products.

The tendency to foaming and foam degradation of cutting liquid products is an important property for the engineering industry. The results of the comparison between cutting liquid with and without addition of top-phase polymer according to the invention did not show any significant difference as regards foaming.

The addition of polymer to a cutting liquid results in a certain increase of viscosity. The effect of this increase of viscosity could also be seen in sedimentation tests using a fine powder of reduced iron. It was found that 30% of the added amount of iron powder had not sedimented after 30 seconds in a cutting liquid without addition of polymer. The corresponding value for the cutting liquid according to the invention was 50%. It can further be mentioned that inorganic particles, which are present in the polymeric two-phase systems, will not be distributed into the top-phase, i.e. the cutting liquid phase. The result is that also inorganic particles in the system will be removed together with microorganisms in the bottom-phase.

Hard crystalline evaporation residues from a cutting liquid may have a negative effect on movable machine parts and precision tools. The evaporation tests with the mineral oil based fine emulsion with addition of polymer according to the invention showed that the product could not be evaporated, probably because a formed surface layer prevented water from escaping. Other evaporation tests using both mineral oil based and semi-synthetic emulsion concentrates containing polymer according to the invention and water showed that no hard crystalline evaporation residue was formed. In the case with the mineral oil based concentrate two-phases were obtained, one consisting of concentrate and the other of the added top-phase polymer.

The fact that polyethylene glycol, after evaporation, does not form a homogenous liquid with mineral oil based concentrates does not seem to be of any significant importance.

Separation Tests

In all of the separation tests the following two types of emulsion concentrates were used; semi-synthetic fine emulsion (5-Star-40, Cincinnati, Millacron) and mineral oil based rough emulsion (Multan 94-2, Henkel Kemi).

Each of the emulsions were tested as follows:

1. 0.6 g of Polyethylene glycol 600 were mixed with 0.2 g emulsion concentrate and 3.2 g water having bacterial cells (about $2\times10^8$ bacterial cells/ml) or, alternatively, fungi spores (about $5\times10^7$ spores/ml) suspended therein.
2. 0.8 g Polyethylene glycol 600 was mixed with 0.2 g emulsion concentrate and 3.0 g water as above.
3. 0.8 g Polyethylene glycol 600 and 0.1 g Polyethylene glycol 8000 (Carbowax 6000, Union Carbide, New York, USA) were mixed with 3.2 g water as above.

A polymer mixture consisting of diethylaminoethyl dextran (DEAE-dextran) and below listed polymers was added to each of the systems for the separation test:

a) Dextran 500 (molecular weight 500,000, Pharmacia Fine Chemicals, Uppsala)
b) Dextran (Batch 30-0472-00)
c) Dextran (Fraction I)
d) Soluble potatoe starch (Kebo Lab AB, Solna).

The final concentration in the system was 0.001% for DEAE-dextran and 1% for the other polymers (w/w).

After mixing and phase separation 1 ml of the top-phase (emulsion+polyethyleneglycol phase) was removed and then diluted in steps of $10^1$; thereafter each dilution step was seeded on culture substrates for fungi and bacteria.

Culture Media and Cultivation Conditions

The quantification of the number of fungi elements was performed by cultivation on a substrate composed of 2% (w/w) of malt extract (Oxoid, L 39), 1.5% Agar (Oxoid, L 28) and 30 mg/l of streptomycin sulphate (Sigma Chemical Co.). Incubation was carried out at room temperature (22° C.) during 4 days, after which the number of colony forming units could be determined.

The concentration of bacteria was determined by the cultivation on a substrate composed of 2.4% (w/w) Tryptone Glucose Extract Agar (CM 127, Oxoid), 0.2% Casein Hydrolysate (Acid) (L 41, Oxoid) and 50 mg/l Actidione (Sigma).

The number of colony forming units was determined after incubation for six days at room temperature.

The results of separation tests performed with different dextran fractions or soluble starch as the bottom-phase polymer and with the above described composition of the top-phase are presented in Tables 1 and 2.

Table 1

Separation of bacterial cells of Bacillus subtilis using different bottom-phase polymers. The amount of bacterial cells before the separation was $1.6\times10^8$/ml in Systems 1 and 3 and $1.5\times10^8$ in System 2. The final concentration of the bottom-phase polymers was 1%. A semi-synthetic fine emulsion (5-Star-40) was used as the emulsion concentrate.

| Bottom-phase-polymer a) | Bact. conc. after sep. (Purification effect) | | | | | |
|---|---|---|---|---|---|---|
| | System 1 | (%) | System 2 | (%) | System 3 | (%) |
| Dextran 500 | b) | — | $1.0\times10^7$ | (93) | $0.8\times10^7$ | (95) |
| Dx 30-0472-00 | b) | — | $1.1\times10^7$ | (93) | $1.3\times10^7$ | (92) |
| Dx Fraction I | b) | — | $0.9\times10^7$ | (94) | $0.9\times10^7$ | (95) |
| Starch | $1.7\times10^7$ | (89) | $2.0\times10^7$ | (87) | $1.5\times10^7$ | (91) |

a) including 0.001% DEAE-Dextran
b) does not form two-phases

In one case a semi-synthetic fine emulsion was used together with the top-phase polymers (Table 1), and in the other case a mineral oil based rough emulsion (Table 2). Together with the bottom-phase polymers also diethylaminoethyl-dextran (DEAE-dextran) was added to a final concentration of 0.001%.

The separation of a known amount of bacterial cells from the top-phases containing the semi-synthetic fine emulsion proved to be very good (87–95%) substantially independently of the type of bottom-phase polymer (Table 1). The effect was enhanced by the presence of the positively substituted diethylamino-ethyl-dextran which is distributed into the bottom-phase of the system. At the high pH prevailing in the system, negative charges on the cell surfaces of the bacteria will be exposed and the cells attracted to the positively charged bottom-phase (cutting liquids usually have a pH of 7–9).

Corresponding separations of fungal spores from a mineral oil based rough emulsion are presented in Table 2. Like in the case with bacterial cells a very high degree of separation (96–98%) was obtained, enhanced by the presence of DEAE-dextran and the high pH in the system.

Table 2

Separation of mould fungi spores of Penicillium brevicompactum using different bottom-phase polymers. The amount of fungal spores before separation was $4\times10^7$/ml (Systems 1 and 3) and $3.8\times10^7$ in System 2. The final concentration of the bottom-phase polymers was 1%. A mineral oil based rough emulsion (Multan 94-2) was used as the emulsion concentrate.

| Bottom-phase polymer a) | Spore konc. after sep. (Purif. effect) | | | | | |
|---|---|---|---|---|---|---|
| | System 1 | (%) | System 2 | (%) | System 3 | (%) |
| Dextran 500 | b) | — | $1.1\times10^6$ | (97) | $0.7\times10^6$ | (98) |
| Dx 30-0472-00 | b) | — | $1.4\times10^6$ | (96) | $1.0\times10^6$ | (97) |
| Dx fraction I | b) | — | $1.0\times10^6$ | (97) | $1.1\times10^6$ | (97) |

-continued

| Bottom-phase polymer a) | Spore konc. after sep. (Purif. effect) | | | | | |
|---|---|---|---|---|---|---|
| | System 1 | (%) | System 2 | (%) | System 3 | (%) |
| Starch | $1.5\times10^6$ | (96) | $1.4\times10^6$ | (96) | $1.0\times10^6$ | (97) |

a) including 0.001% DEAE-Dextran
b) Does not form two phases

In summary it appears from the tests that the top-phase polymers according to the invention with excellent results can be included in cutting liquids and at the same time function as the top-phase in a two-phase system for microbial cleaning of the cutting liquid.

As regards dextran, a broad range of fractions, from finely fractioned Dextran 500 (molecular weight 500,000) to more unfractionated (and consequently cheaper) raw dextran have been tested and found to be very useful. When using high molecular dextran it has been found to be especially advantageous with a top-phase concentration of about 19% (w/w) of Polyethylene glycol 600 or, alternatively, about 12.5% Polyethylene glycol 600+2.5% Polyethylene glycol 8000. In the latter case it is suitable to use a semi-synthetic cutting liquid concentrate.

When purifying these systems the amount of dextran may be about 1%, resulting in a bottom-phase volume making up about 3–5% of the total system.

As mentioned dextran may be replaced by other high molecular polymers, e.g. soluble starch, glucogen or synthetic polyglucose, as the bottom-phase polymer.

In tests using soluble starch, Polyethylene glycol 600 (16% solution) was mixed with soluble starch to a final concentration of 1%. Like in the dextran case the bottom-phase volume was small compared to the total system. In contrast to dextran soluble starch gives a more gel-like bottom-phase.

High molecular polyethylene glycols (mw >1000), which are crystalline at room temperature, are not soluble in a concentrate based on mineral oil only, but is highly soluble in synthetic emulsion concentrates. Evaporation tests using a mixture of 2.5% (weight/-weight) of Polyetheylene glycol 8000 (Carbovax 6000), 5% (w/w) of semi-synthetic emulsion concentrate (fine emulsion), and 12.5% (w/w) of Polyethylene glycol 600 did not produce any crystalline residue.

As mentioned above the bottom-phase polymer may consist of unfractionated or substantially unfractionated raw dextran. Such raw dextran preferably has a molecular weight of 5–40 millions, and it is preferably used in mixture with a small amount of positively charged polymer such as DEAE-dextran. Raw dextran is the presently preferred material for the bottom-phase polymer since it is both cheap and efficient. It is especially preferred to use raw dextran which has been substituted with a small amount of positively charged groups, e.g. DEAE groups, in which case it is not necessary to add any separate charged polymer when there is a need thereof. Also raw fractions of other polysaccharides can be used in corresponding manner. The polymer contents can be as low as about 0.01%.

It has especially been found that the combination of this type of bottom-phase polymer (raw dextran etc.) with the above mentioned "dual-function" top-phase polymer (which itself serves both as a top-phase polymer and as a cutting oil) results in both excellent separation results and superior cutting liquid properties, as is illustrated by the following test.

Top-Phase Polymer As Synthetic Cutting Liquid

A synthetic cutting liquid was prepared by mixing the following components in water to the indicating concentrations.

| | |
|---|---|
| Emkarox VG 680W (a polyoxyalkylene glycol ether from ICI) | 6% |
| Synperonic T/701 (a foam inhibitor from ICI) | 0.1% |
| Phosphate buffer | to pH about 7 |
| Water | q.s. |

The utility of the obtained cutting liquid was tested in machining tests and was rated as category 2, which means high class cutting liquid.

The utility of the cutting liquid as a top-phase system for purification according to the invention was tested as follows:

Bacterial cells and fungal spores were added (in the above described manner) to the above cutting liquid to simulate a microbially contaminated cutting liquid. Raw dextran (molecular weight 5–40 millions, final concentration 0.1%) with added DEAE-dextran (final concentration 0.01%) was used as the bottom-phase polymer. The top and bottom-phases were mixed and allowed to separate; 97–99% of the bacteria and about 99% of the fungi were transferred into the bottom-phase and separated.

Microbial Analysis of Contaminated Cutting Liquid

A presently preferred embodiment of the analysis method according to the invention for quantification of the microbial contamination of cutting liquids will now be described as an illustrative but non-limiting example. The results of the analysis can e.g. be used for judging the quality of the used cutting liquid.

A pre-determined amount of a polymeric two-phase system according to the invention was added to a test bottle having a sealable, preferably "pipette shaped" stopper. A bottle holding a total of about 50 ml can e.g. be charged with 20 ml of the system in advance, sealed and delivered to the user. When taking a sample an aliquote (20 ml) of a cutting liquid sample is "pipetted" into the bottle, which is then shaken so as to mix the phases and then allowed to separate with the bottle turned upside down. The bottle may preferably be compressible and have a suitable visible volume scale. The separation is normally very good already after 10 to 20 seconds, but it is preferred to allow the separation to proceed for a few minutes. Already at this stage it is possible to get a good idea of the degree of microbial contamination of the cutting liquid by turbidimetric reading of the bottom-phase (which substantially consists of salt solution, e.g. phosphate buffer pH about 6.8) and comparison with a standard curve for a corresponding system, prepared in a manner known per se. It is, however, preferable to make a further separation step in which the bottom-phase from the first step (e.g. 10 ml of bottom-phase), which is rich in biomass, is mixed with a suitable polymer for a second phase system (e.g. 4 g of polypropylene glycol having a molecular weight of about 425). Since in the preferred embodiment (separation in a bottle which is turned upside down), the bottom-phase from the first separation is located closest to the opening of the bottle, which preferably is "pipette shaped", the transfer and metering to the second system can be done very conveniently. Also this second separation can be carried out in a pre-prepared bottle designed similarly as the first bottle. The second bottle is shaken so as to mix the phases well, then allowed to rest until the phases have separated (normally the same separation times as for the first separation are preferred), and a predetermined amount of the biomass-enriched bottom-phase is taken out for turbidimetric analysis and comparison with a standard curve (which expression also includes a specific mathematical relation or any other relation for quantification of the measured value which has been determined in advance). Before the reading, the sample may optionally be diluted with e.g. particle-free water (in the given specific example e.g. 2 ml sample plus 2 ml of particle-free water). If desired, the amount of live biomass can be determined in the above indicated manner, e.g. by using fluorescinediacetate (FDA) as a marker.

High-Concentration of Diluted Polymer Solutions

The separation method according to the invention can also advantageously be used for making used cutting liquids or other lubricating liquids such as waste oil disposable. At present, the disposal of e.g. synthetic or semi-synthetic cutting liquids is a very costly process because it is very difficult to concentrate diluted polymer mixtures (and the polymer cannot be disposed of just anywhere). The disposal costs can often be as high as the purchase price. According to the invention this problem can be easily remided by strongly concentrating the polymer, e.g. in the following way.

A used-up cutting liquid containing about 7% by weight of Emkarox (see above) as the top-phase polymer is mixed with about 60% phosphate buffer (bottom-phase) to a final concentration of 25% and allowed to separate (from a minute to an hour or so). A very concentrated and easily separable polymer top-phase is formed (e.g. 35–50%, total volume about 5% of the cutting liquid volume), which can be destructed, whereas the aqueous phase usually can be disposed of directly.

I claim:

1. A method for removing microbial contaminants from a lubricating agent which comprises:

1) mixing the contaminated lubricating agent with an aqueous two-phase system to form a mixture, said system being a composition containing two immiscible aqueous phases, one phase being a top phase containing a hydrophilic polymer dissolved in water and the other phase being a bottom phase, said bottom phase being an aqueous solution containing a component dissolved therein, said component being selected from the group consisting of:
   (a) a bottom phase polymer which, when dissolved in water, forms an aqueous solution that is immiscible with the top phase; said bottom phase polymer having a molecular weight which is higher than the molecular weight of the hydrophilic polymer in the top phase; and
   (b) a water-soluble inorganic salt which, when dissolved in water, forms an aqueous solution that is immiscible with the top phase;
2) allowing the mixture to stratify into said top phase containing the lubricating agent therein and said bottom phase containing at least a portion of the microbial contaminants therein, wherein a microbial enriched bottom phase is formed; and then 3) separating at least a major portion of the microbially enriched bottom phase from the top phase.

2. The method of claim 1 wherein the hydrophilic polymer of the top phase is not a solid at room temperature.

3. The method of claim 1 wherein the hydrophilic polymer in the top phase is a solid at room temperature and said top phase further includes a solvent for the solid polymer.

4. The method of claim 1 wherein the hydrophilic polymer in the top phase is a polyalkylene glycol.

5. The method of claim 4 wherein the polyalkylene glycol is polyethylene glycol having an average molecular weight of 200–20,000.

6. The method of claim 5 wherein the average molecular weight of the polyethylene glycol is 400–10,000.

7. The method of claim 6 wherein the average molecular weight of the polyethylene glycol is 600–4,000.

8. The method of claim 1 wherein the component in the bottom phase is a polymer having an average molecular weight of at least 40,000.

9. The method of claim 8 wherein the bottom phase polymer is selected from the group consisting of polysaccharide, polyvinyl alcohol and cross-linked mono-, di- or oligo-saccharide.

10. The method of claim 9 wherein the bottom phase polymer is a polysaccharide selected from the group consisting of dextran, starch, cellulose and polyglucose.

11. The method of claim 9 wherein the polysaccharide is cross-linked.

12. The method of claim 9 wherein the bottom phase polymer is a cross-linked mono-, di- or oligo-saccharide.

13. The method of claim 9 wherein the bottom phase polymer is a mixture of polyvinyl alcohols of different average molecular weights.

14. The method of claim 9 wherein the bottom phase component further includes a charge-exposing agent carrying a positive electric charge to attract the negative charges on the cell surfaces of the microbial contaminants; said charge-exposing agent being a hydrophilic polymer containing positively-charged groups.

15. The method of claim 14 wherein the aqueous two-phase system has a pH which is from neutral to slightly basic so as to expose the charges on the cell surfaces of the microbial contaminants.

16. The method of claim 1 wherein the component in the bottom phase is a buffer salt.

17. The method of claim 16 wherein the buffer salt is selected from the group consisting of alkali metal phosphates, sulfates and mixtures thereof.

18. The method of claim 1 wherein the lubricating agent comprises a polymer which is also present in the top phase of the polymeric two-phase system.

19. The method of claim 18 wherein the lubricating agent is a polyoxyalkylene glycol ether or an ethylene or propylene oxide polymer.

20. The method of claim 1 wherein the top phase of the polymeric two-phase system comprises a hydrophilic polymer which is not solid at room temperature and a hydrophilic polymer which is solid at room temperature.

21. The method of claim 20 wherein the top phase further comprises a solvent for the solid hydrophilic polymer.

22. The method of claim 1 wherein the lubricating agent is a cutting fluid.

23. A device for microbial purification of a lubricating agent which comprises:

1) A mixing chamber for mixing top and bottom immiscible liquid phases therein; said mixing chamber including a first mixing chamber inlet conduit for introducing the top liquid phase therein, and a second mixing chamber inlet conduit for introducing the bottom liquid phase therein; means for mixing the two phases in the mixing chamber and a mixing chamber outlet conduit for removing the mixed phases from the mixing chamber;

2) a separation chamber for receiving the two mixed phases from the mixing chamber and for allowing said phases to stratify into top and bottom phases within said separation chamber; said separation chamber being connected to said mixing chamber by said mixing chamber outlet conduit;

3) first and second separation chamber outlet conduits connected to said separation chamber; said second separation chamber outlet conduit being located below said first separation chamber outlet conduit for removing the bottom phase from said separation chamber; and said first separation chamber outlet conduit being located above said second separation chamber outlet conduit for removing the top phase from the separation chamber, wherein the first separation chamber outlet conduit is connected to a tank so that the top phase in the separation chamber can flow into said tank; and said tank includes a first tank outlet conduit connected to said first mixing chamber inlet conduit for the introduction of said to phase into said mixing chamber and said tank further includes a second tank outlet conduit for distributing the top phase to a distribution system and said tank further includes a tank inlet conduit for returning the top phase to the tank from the distribution system, and wherein the second separation chamber outlet conduit is connected to a means for removing microbial contaminants from the bottom phase to produce a purified bottom phase and said device further includes means to return said purified bottom phase to the mixing chamber via said second mixing chamber inlet conduit.

* * * * *